United States Patent [19]

Braun et al.

[11] 4,416,643

[45] Nov. 22, 1983

[54] PLANAR DRIVE DEVICE

[75] Inventors: Ernst Braun; Gert Braun, both of Essen-Heisingen, Fed. Rep. of Germany

[73] Assignee: Halbach & Braun, Fed. Rep. of Germany

[21] Appl. No.: 231,755

[22] Filed: Feb. 5, 1981

[30] Foreign Application Priority Data

Feb. 8, 1980 [DE] Fed. Rep. of Germany ..... 3004663

[51] Int. Cl.[3] ..... E21C 27/34; E21C 29/16

[52] U.S. Cl. ..... 464/38; 192/107 M; 464/41; 464/82

[58] Field of Search ..... 464/37, 38, 41, 42, 464/43, 82; 192/56 R, 76, 107 M

[56] References Cited

U.S. PATENT DOCUMENTS

| | | | |
|---|---|---|---|
| 1,942,512 | 1/1934 | Lee | 464/43 |
| 2,747,713 | 5/1956 | Light | 192/107 M |
| 2,763,141 | 9/1956 | Dodge | 464/43 X |
| 3,503,478 | 3/1970 | Neumann | 464/42 X |
| 3,762,183 | 10/1973 | Bolliger | 464/37 X |
| 3,927,537 | 12/1975 | Anderson et al. | 464/37 X |
| 3,984,999 | 10/1976 | Kopp | 464/41 |
| 4,067,425 | 1/1978 | Soter | 192/76 X |
| 4,091,904 | 5/1978 | Beyer | 192/107 M |

FOREIGN PATENT DOCUMENTS 2702178 2/1980 Fed. Rep. of Germany .

*Primary Examiner*—John M. Jillions
*Assistant Examiner*—Daniel P. Stodola
*Attorney, Agent, or Firm*—McGlew and Tuttle

[57] ABSTRACT

A planar drive mechanism comprises a sprocket wheel for a planar chain and a drive shaft for rotating the sprocket wheel. The sprocket wheel has a secondary rim portion for driving the chain and the drive shaft has a primary rim. A clutch mechanism is connected between the primary and secondary rims which comprises a circular groove of trapazoidal cross section formed in the secondary rim which receives a plurality of friction segments connected to the primary rim. Each friction segment is carried by a coupling bolt which is slidably mounted in radially extending bores in the primary rim aligned with the circular groove. The coupling bolts and friction heads while functioning as a unit can be made of two separate materials, the coupling bolt made of material to give it strength and the friction segments made of material to give it wear resistance.

9 Claims, 3 Drawing Figures

PLANAR DRIVE DEVICE

FIELD AND BACKGROUND OF THE INVENTION

The present invention relates in general to clutches for driving units and, in particular, to a new and useful planer drive mechanism with a clutch formed between a secondary and a primary rim.

As is well known, a friction clutch is an overload clutch which slips as soon as the transmitted torque exceeds a maximum of the friction torque.

According to German Pat. No. 2,702,178, a friction clutch is provided in drives for planer sprocket wheels instead of the usual shearing safety bolts, so that operating problems caused by broken safety bolts are avoided. The same goes for chain shocks transferrred to the adjacent part of the transmission upon safety bolt ruptures. The friction torque is predetermined by the depth or degree of engagement of the tapered heads of the coupling bolts in the conformable circular groove of the sprocket wheel rim. The centering ring, which is freely mounted within the primary rim, provides for a uniform contact pressure of the coupling bolts and for a pressure equilibration by elastic deformation. In this prior art, however, the friction clutch, the coupling bolts and their tapered heads form an integral unit, i.e. the heads are formed by beveling the bolt shank end. The size, and thus the area of the frictional surfaces, are determined by the diameter of the shank, and the bolt heads are necessarily made of the same material as the coupling bolts themselves, wherefore, they have a relatively low coefficient of friction. The limited friction areas result in a need for relatively high specific contact pressures, causing an increased wear. The wear is aggravated by the fact that the tapered bolt heads simultaneously produce a shaving effect within the circular groove, and the coefficient of friction is predetermined by the material employed for making the coupling bolts.

SUMMARY OF THE INVENTION

The present invention is directed to a development of a planer drive device of the above-mentioned kind which, however, solves the above-mentioned drawbacks and ensures a very low wear of the friction clutch and the coupling elements thereof.

In accordance with the invention the tapering bolt heads are designed as friction segments which are secured to the coupling bolts. The tapering bolt heads are thus separate coupling elements, and different materials can be employed for the bolts proper and their heads. Strength is the determining property for selecting the material of the bolts, and the coefficient of friction and resistance to wear are the factors in regard to the bolt heads. Further, since the tapering bolt heads are now designed as friction segments which are secured to the coupling bolts, much larger friction areas become engaged in the circular groove so that the specific pressures needed are reduced quite substantially. This counts particularly if, in accordance with a preferred embodiment of the invention, the friction segments form a close to continuous ring, with a predetermined clearance of motion between the individual segments in the circumferential direction.

The clearance between the friction segments is provided to prevent the front edges of the segments from producing a shaving effect upon a slip of the clutch. That is, due to the fact that the coupling bolts press the friction segments into the circular groove in a centrally manner, the pressure in the edge zones of the segments is considerably smaller than at the center of each segment. This causes a bulging of the segments at their center and an inward deflection of the edge zones. The clearance between the segments is intended for allowing this deflection. A seizure of the friction segments in the circular groove is also thereby securely prevented and the wear is reduced to a minimum.

This effect is considerably improved by another inventive provision, namely that, to concentrate the central loading of the segments engaged in the central groove and relieve the edge zones as far as possible, each coupling bolt is shaped with an end portion of smaller diameter terminating in a centering cone. The friction segments are preferably made of a wear-resistant metal alloy for example CrMn steel or chilled cast iron. Advantageously, the tapering side faces of the segments which are exposed to friction, are provided with wear resistant inserts of such a material i.e. of CrMn steel or chilled cast iron.

The inventive design has the advantage that the friction clutch provided between the sprocket wheel and the driveshaft thereof, of a planer drive device, is subjected to an extremely small wear because the coupling bolts can be equipped with friction segments independently of the material used therefor. Nevertheless, the determining factor for selecting this material is a steady or constant coefficient of friction. Also, the friction segments have particularly large friction areas so that relatively low specific pressures are needed and obtained. The wear is further reduced by the central loading of the friction segments producing the effect that the edge zones are less strained, so that they do not tend to seize and the otherwise unavoidable shaving of these edges during a slip of the clutch is avoided. The final result is that the life of the friction clutch of the inventive planer drive is extended.

Accordingly, an object of the present invention is to provide a planer drive mechanism comprising a sprocket wheeel for a planer chain and a drive shaft for the sprocket wheel, the sprocket wheel having a secondary rim and the drive shaft having a primary rim, with a clutch formed between the primary and secondary rims comprising the secondary ring having a circular groove of trapazoidal cross section formed therein, the primary rim having a plurality of radially extending circumferentially spaced bores therethrough aligned with the circular groove and containing movable coupling bolts each having a tapered head, with friction segments centrally mounted on each tapered head and engaged with the circular groove, the coupling bolts being biased to hold the segments into contact with surfaces of the circular groove.

A further object of the invention is to provide such a device wherein the shape of the segments is chosen to form a substantially continuous friction ring in the circular groove having clearances between each segment to permit slight deformation of each segment when it is moved by its respective coupling bolt into the circular groove. A still further object of the invention is to provide each segment in an area thereof in contact with the circular groove, with a wear-resistant insert.

Another object of the invention is to provide a planer drive mechanism or driving unit with clutch which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its use, reference is made to the accompanying drawings and descriptive matter in which a preferred embodiment of the invention is illustrated.

DESCRIPTION OF THE PREFERRED EMBODIMENT

Figures 1, 3:
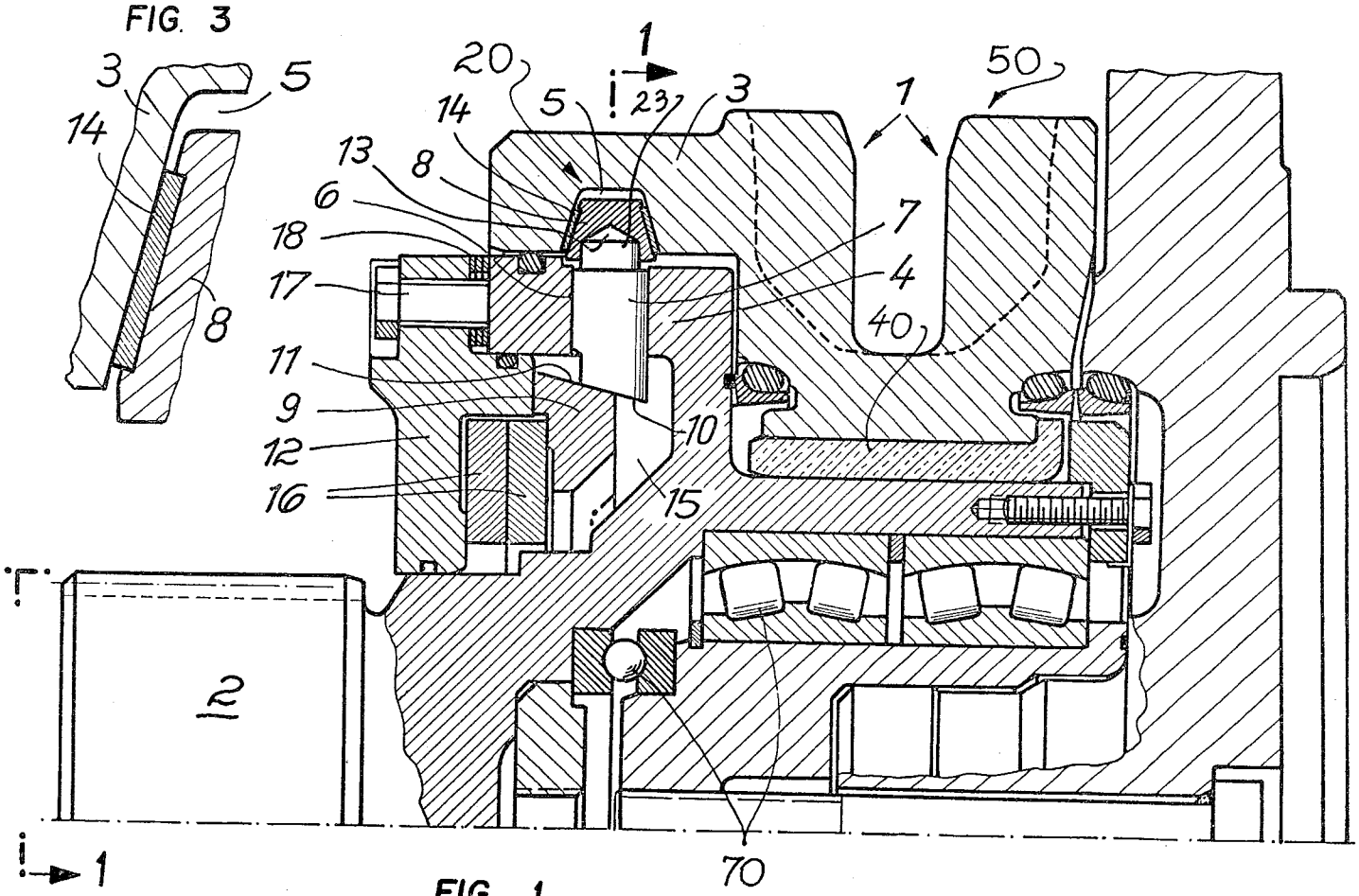
FIG. 1 is a partial sectional view of an inventive planer drive.
FIG. 3 is an enlarged partial view of FIG. 2.
Figure 2:
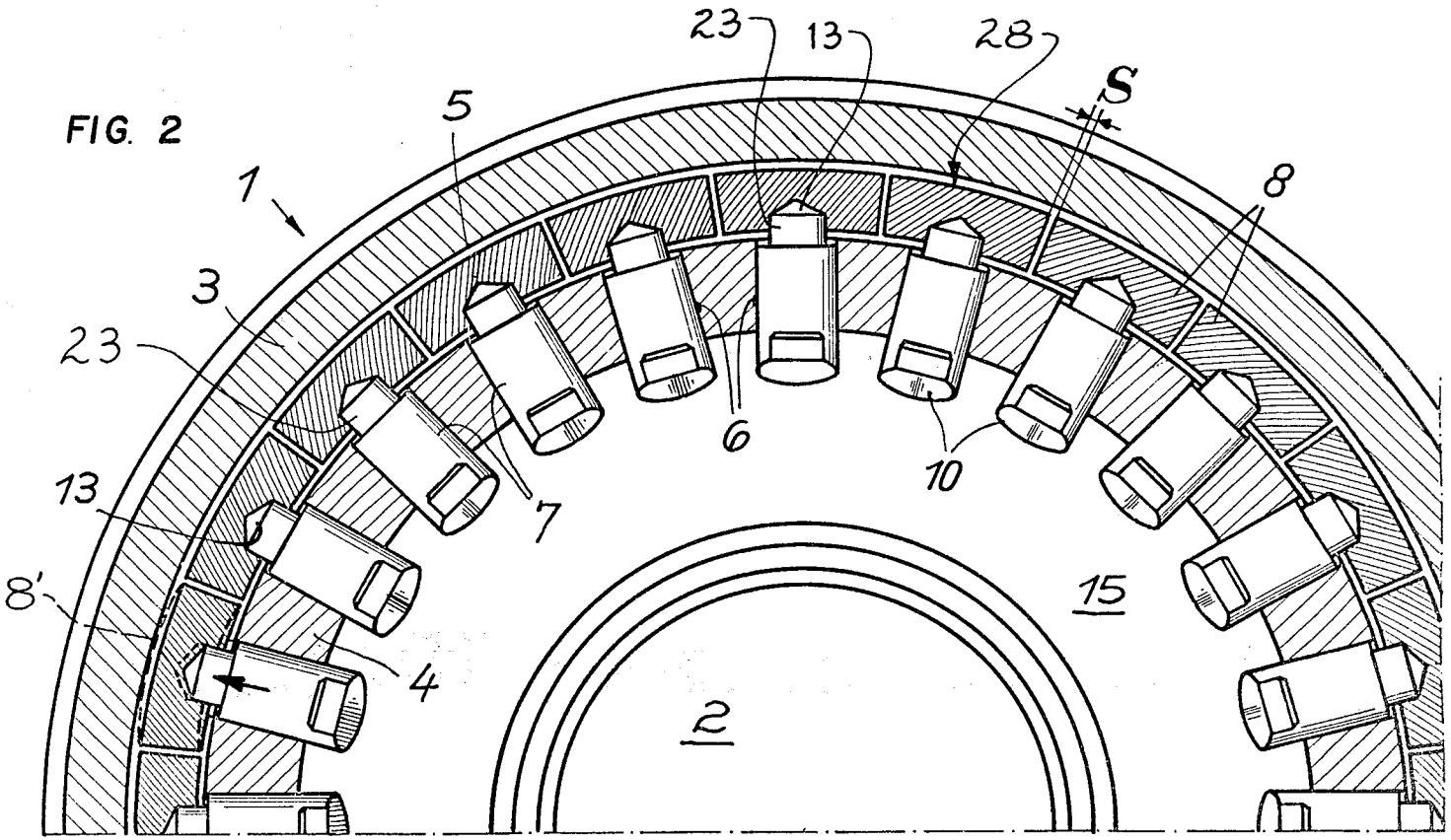
FIG. 2 is a partial radial section taken along the line 1—1 of FIG. 1.

Turning to the drawings in particular, the invention embodied therein comprises, a driving unit having a primary and secondary rim with a clutch therebetween for permitting slippage between the primary and secondary rims. The unit is primarily utilized as a planer drive mechanism for driving a planer chain.

The figures show a planer drive device comprising a sprocket wheel 1 for a planer chain and a drive shaft 2 for wheel 1. Neither the drive motor nor the transmission for the drive shaft and the planer chain, are shown. Sprocket wheel 1 has a rim referred to hereinafter as a secondary rim 3 and drive shaft 2 is formed with a rim referred to as a primary rim 4. Primary rim 4 and secondary rim 3 form a friction clutch generally designated 20. For this purpose, secondary rim 3 is provided with a circular groove 5 having a trapazoidal cross section, and primary rim 4 is provided with radial bores 6 which are distributed over the circumference thereof and aligned with groove 5 and in which coupling bolts 7 are received which can be wedged into groove 5 by means of friction heads or segments 8, conformable to the groove.

To effect this wedging engagement of the friction heads, a centering ring 9 having a beveled surface 11 operating on the bases 10 of the bolts, is freely mounted for radial displacement within primary rim 4 by means of a pressure ring 12. To obtain minimum specific contact pressures, as large a number of coupling bolts 7 as possible is distributed over the circumference of the primary rim, and in addition, friction heads 8 are designed as friction segments which are secured to bolts 7.

Friction segments 8 form a close to continuous ring, generally designated 28; with a clearance of motion S between the individual segments 8. Each coupling bolt 7 is shaped with an end portion of smaller diameter 23 and a centering cone 13. The respective friction segments 8 each have a central blind bore which receives the bolt end portions. Segments 8 are thus centrally engaged with bolts 7. The effect thereof is that friction segments 8 become bulged or curved outwardly at their center and deflected radially inwardly at their edges, paricularly their frontal end edges, whereby a shaving effect on the groove 5 surface, in these zones, upon a slip of the clutch, is eliminated. Spacings S are provided to permit such bulging or deformation and to prevent seizure of the segments 8 in the groove 5. The bulging and deflection are indicated at one of the segments 8', in dotted lines.

Friction segments 8 are made of a wear resistant metal alloy (CrMn, for example) and may be provided in addition with wear resistant inserts 14 in their exposed surfaces or tapered side faces, to ensure a steady coefficient of friction (see FIG. 3).

Primary rim 4 is formed with an annular chamber 15 for receiving the centering ring 9 and the pressure ring 12. The coupling bolts 7 have oblique bases 10 which, however, may also be spherical or conical. Centering ring 9 is of high strength and resiliently flexible. It is made of steel, for example. Pressure ring 12 applies through cup springs 16 against centering ring 9 and can be clamped thereto by means of screw bolts 17. The desired biasing force for a proper operation of the clutch is obtained by tightening bolts 17 which are associated with spacers 18 provided between pressure ring 12 and primary rim 14.

To permit clutch slippage between rims 3 and 4, rim 3 is mounted with a slide member 40, to drive shaft 2, which carries rim 4.

A planer chain (not shown) is carried on rim 3 in an area 40 thereof and drive shaft 2 is mounted for rotation through bearings 70.

While a specific embodiment of the invention has been shown and described in detail to illustrate the application of the principles of the invention, it will be understood that the invention may be embodied otherwise without departing from such principles.

What is claimed is:

1. A planer drive mechanism comprising, a sprocket wheel for driving a planer chain, a drive shaft for driving the sprocket wheel, said sprocket wheel having a secondary rim, said drive shaft having a primary rim, friction clutch means connected between said primary and secondary rims for permitting limited movement therebetween, said secondary rim having a circular groove of trapezoidal cross-section defined therein, said primary rim having a plurality of radially extending circumferentially spaced bores therein aligned with said circular groove, a coupling bolt movably received in each of said bores adapted to be moved toward said circular groove, each coupling bolt having a tapered bolt head secured on a side thereof adjacent said circular groove, a centering ring movably mounted on said drive shaft having a bevelled surface in engagement with a base of each of said coupling bolts, a pressure ring connected to said drive shaft and bearing against said centering ring to bias said coupling bolts radially outwardly toward said circular groove through said bevelled surface and said coupling bolt bases, each of said tapered bolt heads comprising a separate friction segment frictionally engaged with said circular groove, said friction segments are shaped and distributed in said circular groove to form a substantially continuous friction ring having a small clearance between adjacent friction segments in a circumferential direction of said circular groove, each coupling bolt includes a small diameter portion with a centering cone, each friction segment having a blind bore therein for receiving said small diameter portion and centering cone for biasing said friction segments at a central location thereof into engagement with said circular groove whereby each friction segment is bulged outwardly at a central portion thereof in said circular groove.

2. A planer drive mechanism according to claim 1, wherein said friction segment is made of material different from said coupling bolts, said material of said friction segments comprising wear resistant metal alloy.

3. A planer drive mechanism according to claim 2, wherein said wear resistant metal alloy is chosen from the group consisting of CrMn steel and chilled cast iron.

4. A planer drive mechanism according to claim 2, wherein each friction segment includes tapered sidewalls adjacent sidewalls of said circular groove, a wear resistant insert in each of said sidewalls made of wear resistant material in engagement with the circular groove sidewalls.

5. A planer drive mechanism according to claim 4, wherein the material of said wear resistant inserts is chosen from the group consisting of CrMn steel and chilled cast iron.

6. A planer drive mechanism according to claim 1, wherein each of said friction segments has a trapazoidal cross sectional shape substantially conformant to the trapazoidal cross sectional shape of said circular groove, said friction segments having tapered sidewalls engaged with tapered sidewalls of circular groove and adapted to be biased at a central location thereof into said circular groove to bulge each friction segment outwardly in a central portion thereof, whereby edges of said friction segments on opposite sides thereof line in said circular groove are maintained out of contact with surfaces of said circular groove.

7. A planer drive unit with clutch comprising:

a drive shaft having a primary rim;

a sprocket wheel for driving a planer chain having a secondary rim mounted to said drive shaft for limited rotation with respect thereto; and friction clutch means connected between said primary and secondary rims;

said friction clutch means comprising said secondary rim having a circumferential groove defined therein, said primary rim having a plurality of radially extending circumferentially spaced bores therein aligned with said groove, a coupling bolt movable in each of said bores, a friction segment secured to each of said coupling bolts and held thereby in frictional engagement with said groove, and biasing means biasing said coupling bolts and friction segments toward said groove;

said circumferential groove being trapezoidal in cross-section and having tapered side walls, each of said friction segments having tapered side walls substantially conforming to said side walls of said groove, a wear resistant insert in each of said friction segment side walls engaged with one of said groove side walls, said friction segments together forming a substantially continuous friction ring having a clearance between adjacent friction segments sufficient to permit deformation of said friction segments caused by pressure exerted by said biasing means through said coupling bolts;

said biasing means comprising a centering ring movably mounted on said drive shaft and having a bevelled surface, each of said coupling bolts having a bevelled base engageable by said bevelled surface of said centering ring, a pressure ring connected to said drive shaft and bearing against said centering ring to bias said coupling bolts radially outwardly toward said groove, each coupling bolt has a small diameter portion extnding toward said groove with a centering cone connected to said small diameter portion, each of said friction segments having a central blind bore for receiving said small diameter portion and centering cone of said coupling bolt, whereby each friction segment is deformed to bulge radially outwardly adjacent the ends thereof in said groove.

8. A drive unit according to claim 7, wherein said friction segments are made at least in part of wear resistant metal alloy.

9. A drive unit according to claim 8, wherein said metal alloy is chosen from the group consisting of CrMn steel and chilled cast iron.

* * * * *